US007556230B2

(12) United States Patent
Sarullo

(10) Patent No.: US 7,556,230 B2
(45) Date of Patent: Jul. 7, 2009

(54) HOLDER FOR BEVERAGE CONTAINERS

(75) Inventor: Phillip Sarullo, Madison, MS (US)

(73) Assignee: S.G. Enterprises, Inc., Madison, MS (US)

( * ) Notice: Subject to any disclaimer, the term of this patent is extended or adjusted under 35 U.S.C. 154(b) by 0 days.

(21) Appl. No.: 11/551,454

(22) Filed: Oct. 20, 2006

(65) Prior Publication Data

US 2007/0181766 A1 Aug. 9, 2007

Related U.S. Application Data

(60) Provisional application No. 60/781,257, filed on Mar. 10, 2006, provisional application No. 60/771,330, filed on Feb. 9, 2006.

(51) Int. Cl.
*A47K 1/08* (2006.01)

(52) U.S. Cl. ..... 248/311.2; 248/311.3; 248/314

(58) Field of Classification Search ..... 248/311.2, 248/311.3, 314
See application file for complete search history.

(56) References Cited

U.S. PATENT DOCUMENTS 2,661,610 A * 12/1953 Treff ..... 248/145.3
2,729,080 A * 1/1956 Bennett ..... 248/145.3
2,784,577 A * 3/1957 Beaham ..... 248/146
2,839,260 A * 6/1958 Jacobi, Jr. ..... 248/146
3,306,566 A * 2/1967 Paulson et al. ..... 248/346.04
4,069,996 A * 1/1978 Koziol ..... 248/146
4,548,348 A 10/1985 Clements
4,726,553 A * 2/1988 Wischusen, III ..... 248/146
4,865,199 A 9/1989 Zimmer
5,071,096 A * 12/1991 Hartmann et al. ..... 248/154
5,102,086 A * 4/1992 Thomason ..... 248/311.2
5,112,017 A * 5/1992 Pang ..... 248/311.2
5,143,247 A 9/1992 Gavle
5,143,337 A 9/1992 Tomayko, Jr. et al.
5,257,765 A 11/1993 Halle
D361,017 S * 8/1995 Keven ..... D7/619.1
5,667,180 A * 9/1997 Duckworth ..... 248/311.2
5,897,041 A * 4/1999 Ney et al. ..... 224/483
5,961,086 A * 10/1999 Moore et al. ..... 248/314
5,975,342 A * 11/1999 Bradeen et al. ..... 220/737
6,059,138 A * 5/2000 Labruyere ..... 220/574
6,315,153 B1 * 11/2001 Osborn ..... 220/737
6,505,802 B2 * 1/2003 Fowler ..... 248/311.2
6,527,239 B1 * 3/2003 Smith ..... 248/311.2
6,641,102 B2 * 11/2003 Veltri et al. ..... 248/311.2
6,832,745 B2 * 12/2004 Lindsay ..... 248/311.2
6,834,838 B2 * 12/2004 Dennis et al. ..... 248/311.2
6,896,231 B1 * 5/2005 Sullivan, Sr. ..... 248/311.2

OTHER PUBLICATIONS

PCT Written Opinion for PCT/US06/44841 mailed Jun. 27, 2008.

* cited by examiner

*Primary Examiner*—J. Allen Shriver, II
*Assistant Examiner*—Michael McDuffie
(74) *Attorney, Agent, or Firm*—Thomas, Kayden, Horstemeyer & Risley, LLP; Todd Deveau

(57) ABSTRACT

A beverage container holder includes a supporting member configured to laterally and axially support a beverage container in an upright position within the beverage container holder, and a stabilizing member configured to stabilize the beverage container holder with respect to a surface on which the holder rests, the stabilizing member having an outer dimension that is greater at a lower end of the stabilizing member than at an upper end of the stabilizing member.

8 Claims, 2 Drawing Sheets

HOLDER FOR BEVERAGE CONTAINERS

CROSS-REFERENCE TO RELATED APPLICATIONS

This application claims priority to U.S. provisional application entitled "The Soda Skirt Beverage Holder," having Ser. No. 60/781,257, filed Mar. 10, 2006, which is entirely incorporated herein by reference.

This application claims priority to U.S. provisional application entitled "The Soda Skirt II Beverage Holder," having Ser. No. 60/771,330, filed Feb. 9, 2006, which is entirely incorporated herein by reference.

FIELD OF THE INVENTION

The present disclosure generally relates to beverage container holders, and more particularly, to beverage container holders that stabilize beverage containers in an upright position.

BACKGROUND

A beverage is usually consumed from a beverage container. The beverage container may be a glass or a cup into which the beverage is poured, or the beverage container may be the packaging in which the beverage is sold. For example, soft drinks and alcoholic beverages are often packaged in cans or bottles, which function as single-serving, disposable beverage containers. Similarly, children's beverages are often consumed directly from the boxes or pouches in which they are packaged.

Often, beverage containers are predisposed to tipping due to the dimension of the height of the container in comparison to the dimension of its base. For example, the height of a soft drink can is often more than twice the diameter of its base, and the height of a beverage bottle is often more than three times the diameter its base. Tipping can be undesirable, in that it wastes the beverage and creates a mess requiring cleaning.

Beverages are often consumed both indoors and outdoors, in which case the beverage container may be placed directly on the ground when the beverage is not being consumed. For example, at a beach the beverage container may be placed on the sand, and at a park the beverage container may be placed on the dirt or in the grass. In such cases, not only is the beverage container subject to tipping, but the bottom of the beverage container may become coated in sand or dirt, which may be undesirable. Indoors, the beverage container may be placed, for example, on a table, desk, countertop, or the floor, where the beverage container is also subject to tipping. Additionally, cold beverage containers can leave condensation rings on a surface where they are placed.

From the above, it is apparent that a need exists for a beverage container holder that stabilizes the beverage container, reducing its likelihood of tipping, while also reducing its contact with debris, and optionally serving as a coaster.

SUMMARY

In one embodiment, a beverage container holder includes a supporting member configured to laterally and axially support a beverage container in an upright position within the beverage container holder, and a stabilizing member configured to stabilize the beverage container holder with respect to a surface on which the holder rests, the stabilizing member having an outer dimension that is greater at a lower end of the stabilizing member than at an upper end of the stabilizing member, and the supporting member dimensioned to receive the beverage container and optionally have the beverage container fit closely within the supporting member.

In one embodiment, a beverage container holder includes a supporting member configured to support the weight of a beverage container, and a stabilizing member configured to restrict the lateral movement of the beverage container at one or more points along a height of the stabilizing member, and configured to stabilize the beverage container holder with respect to a surface on which the holder rests, the stabilizing member having an outer dimension that is greater at a lower end of the stabilizing member than at an upper end of the stabilizing member.

In some embodiments, the stabilizing member includes a handle opening formed through the stabilizing member, the handle opening being configured such that a handle of a beverage container, for example a cup or mug having a handle, can project through the handle opening to an exterior of the beverage container holder.

Other systems, devices, features, and advantages of the disclosed beverage container holder will be or will become apparent to one with skill in the art upon examination of the following figures and detailed description. All such additional systems, devices, features, and advantages are intended to be included within this description, and are intended to be protected by the accompanying claims.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION

Embodiments of a beverage container holder are described below. The beverage container holder is configured to stabilize a beverage container in an upright position above a surface on which the beverage container holder rests, such that the beverage container does not tip or contact debris on the surface. The beverage container holder is also configured to mate, or nest, with a plurality of similarly shaped beverage container holders, such that the holders as a group occupy less space.

Figure 1:
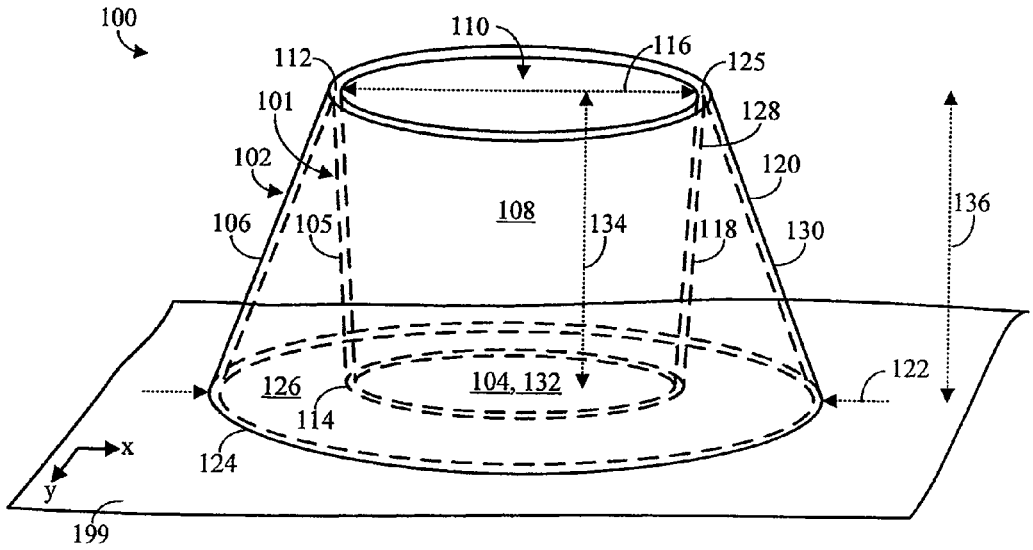
FIG. 1 is a side view of an embodiment of a beverage container holder.

FIG. 1 is a side view of an embodiment of a beverage container holder 100. The beverage container holder 100 is configured such that a beverage container (not shown) that is placed in the holder is stabilized in an upright position. The beverage container holder 100 includes a supporting member 101 and a stabilizing member 102. The supporting member

101 is configured to support the beverage container within the holder 100 in the upright position, while the stabilizing member 102 is configured to stabilize the holder 100 with respect to a surface on which the holder rests.

The supporting member 101 includes a cavity 108, and an opening 110 into the cavity is formed at a top 112 of the cavity. An inner dimension 116 of the cavity 108 is at least the width of the beverage container with which the beverage container holder 100 is intended to be used, such that a beverage container placed into the cavity through the opening 110 is supported by the supporting member 101. In some embodiments, the supporting member 101 is inwardly tapered. In such embodiments, the inner dimension 116 of the cavity 108 may decrease between the top 112 of the cavity and a bottom 114 of the cavity opposite from the top.

To stabilize the beverage container holder 100, the stabilizing member 102 is coupled to the supporting member 101. The stabilizing member 102 is connected to the supporting member 101, such as at upper end 125 that may be, for example, adjacent the opening 110 into the cavity 108. The stabilizing member 102 has a lower end 124 that is configured to contact the surface on which the holder 100 rests. An outer dimension 122 of the stabilizing member 102 is greater at the lower end 124 of the stabilizing member than at the upper end 125 of the stabilizing member. In some embodiments, the outer dimension 122 may be greater at the lower end 124 in more than one direction (x, y), the directions (x, y), defining a plane 199 on which the beverage container holder 100 is configured to rest. For example, the stabilizing member 102 may be outwardly tapered, such that the outer dimension 122 of the stabilizing member 102 is greater at the lower end 124 in every direction (x, y).

In embodiments in which the stabilizing member 102 is outwardly tapered and the supporting member 101 is inwardly tapered, the beverage container holder 100 is configured to mate with other similar shaped beverage container holders. To facilitate inserting two beverage container holders 100 together, a height 134 of the cavity 108 may be less than a height 136 of the stabilizing number 102, such that the supporting member 101 is suspended above the lower and 124 of the stabilizing member.

Although such a configuration is shown in the illustrated embodiment, other configurations are possible. For example, the stabilizing member 102 may be a three-dimensional star shape formed from a series of triangular projections coupled to an outer side of supporting member 101. In such case, the outer dimension 122 may be greater at the lower end 124 in some directions (x, y), but not in others. As a result of the outer dimension 122 being greater in at least one direction at the lower end 124, a void 126 is created between the supporting member 101 and the stabilizing member 102, although the void may be occupied in whole or in part, for example with insulating material. The stabilizing member 102 may also have the shape of a truncated pyramid having, for example a square or triangular base.

In the illustrated embodiment the supporting member 101 includes a base 104 and an inner wall 105, and the stabilizing member 102 includes an outer wall 106. The inner wall 105 forms the cavity 108, such that when a beverage container is placed into the cavity, the inner wall laterally supports the beverage container in an upright position, such as by restricting the lateral movement of the beverage container. The base 104 is configured to substantially support the weight of the beverage container, and is coupled to the inner wall 105 at, for example, the bottom 114 of the cavity 108.

The outer wall 106 is coupled to the inner wall 105 at, for example, the top 112 of the cavity. The inner wall 105 has an inward taper 118 such that the inner dimension 116 of the cavity 108 continuously decreases along the height 134 of the cavity 108, while the outer wall 106 has an outward taper 120 such that the outer dimension 122 of the stabilizing member 102 continuously increases along the height 136 of the stabilizing member 102. For example, the inner dimension 116 of the cavity 108 may continuously decrease from a maximum value at the top 112 to a minimum value at the bottom 114 of the cavity, and the outer dimension 122 of the stabilizing member 102 may continuously increase from a minimum value at the upper end 125 to a maximum value at the lower end 124 of the stabilizing member 102.

In the illustrated embodiment, the inner wall 105 is a sleeve 128, the outer wall 106 is a sleeve, and the base 104 is a disk. The two sleeves 128 and 130 are both frusto-conical and are coupled together at the opening 110 into the cavity 108. The disk 132 is circular and is coupled to the inner sleeve 128 at the bottom 114 of the cavity 108. The inner sleeve 128 has a substantially uniform thickness along the height 134 of the cavity 108, and the outer sleeve 130 has a substantially uniform thickness along the height 136 of the stabilizing member 102.

For example, as illustrated the height 136 of the stabilizing member 102 is about 3 inches, the height 134 of the cavity 108 is about 2.875 inches, and the supporting member 101 is suspended above the lower end 124 of the stabilizing member 102 by about 0.125 inches. The inner and outer sleeves 128, 130 each have thicknesses of about 0.1 inches. The taper 118 is substantially uniform along the height 134 of the cavity 108 so that the inner dimension 116 of the cavity linearly decreases from a maximum diameter of about 3.5 inches at the top 112 of the cavity 108 to a minimum diameter of about 3.25 inches at the bottom 114 of the cavity. The taper 120 of the outer wall 106 is also substantially uniform along the height 136 of the stabilizing member 102 so that the outer dimension 122 of the stabilizing member linearly increases from a minimum diameter of about 3.6 inches at the upper end 125 to a maximum diameter of about 6 inches at the lower end 124.

In embodiments not shown, the beverage container holder 100 can have other dimensions and shapes. For example, the supporting member 101 need not be a base 104 and an inner wall 105, and the stabilizing member 102 need not be an outer wall 106. The inner and outer walls 105, 106 need not be sleeves, the sleeves 128, 130 need not be frusto-conical, or the sleeves 128, 130 may have other dimensions. Additionally, the thicknesses of the sleeves 128, 130 need not be substantially uniform, and the tapers 118, 120 need not be substantially linear. The shape and dimension of the base 104 may also vary depending on the shape and dimension of the inner wall 105. The height 134 of the cavity 108 need not be less than the height 136 of the stabilizing member 102, in which case the supporting member 101 may not be suspended above the lower end 124 of the stabilizing member 102.

Regardless of the size or shape of the beverage container holder 100, the supporting member 101 has the opening 110 through which the beverage container can be placed into the cavity 108, and the stabilizing member 102 has the outer dimension 122 that is greater at the lower end 124 than at the upper end 125 in at least one, and in some cases more than one, direction (x, y). In embodiments in which the beverage container holder 100 is designed to mate, or nest, with other beverage container holders, as described below, the supporting member 101 is inwardly tapered and the stabilizing member 102 is outwardly tapered, such that the void 126 is formed between the two members.

The beverage container holder 100 can be formed from a variety of materials. For example, a non-conductive material can be used, such that the beverage container holder 100 does not tend to conduct heat toward or away from the beverage container, or an insulating material can be used such that the beverage container holder is configured to assist in maintaining the temperature of the beverage container. Alternatively, one or both of the supporting member 101 and the stabilizing member 102 can have a double wall construction, having an inner hollow space between the walls to provide an insulating effect for the beverage container. In some embodiments, the beverage container holder 100 may be formed from more than one material, with different materials being used for different elements of the holder. In such cases, the elements of the holder 100 can be coupled together in any known manner, such as with adhesive. For example, in embodiments in which the void 126 is created between the supporting member 101 and the stabilizing member 102, an insulating material may be placed in the void 126. In such case an end cap may be coupled to the lower end 124 of the beverage container holder 100 to enclose the insulating material within the void 126.

In FIG. 1, the beverage container holder 100 is shown in a first position. The first position may be a functional position in which the beverage container holder 100 stabilizes a beverage container upright within the cavity 108. To use the beverage container holder 100, the holder 100 is placed on a surface, for example the ground, such that the cavity 108 is substantially vertically upright. The beverage container may then be placed into the cavity 108 through the opening 110. When the beverage container is in the cavity 108, the supporting member 101 laterally and axially retains the beverage container in the upright position within the cavity 108, and the stabilizing member 102 stabilizes the beverage container holder 100 due to the increased outer dimension 122 of the holder at the lower end 124. In other words, the supporting member 101 retains the beverage container upright with respect to the beverage container holder 100, and the stabilizing member 102 retains the beverage container holder upright with respect to the surface in which it rests.

When the beverage container holder 100 is in use, a lower portion of the beverage container rests within the holder such that the container is stabilized and does not contact debris on the surface, while an upper portion of the container may project from the holder such that container can be grasped and removed. Therefore, the beverage container holder 100 is designed such that the beverage container can be removed from the holder to consume the beverage and the container can be returned to the holder for retaining the container upright. Further, in embodiments in which the supporting member 101 is suspended above the lower end 124 of the stabilizing member 102, such as in embodiments in which the height 134 of the cavity 108 is less than the height 136 of the stabilizing member, a relatively smaller surface area of the holder 100 is in contact with the surface on which the holder rests, such that contact with debris on the surface is reduced.

Figure 2:
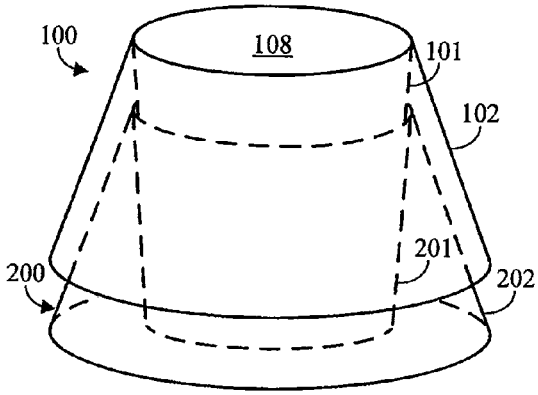
FIG. 2 is a side view of the beverage container holder shown in FIG. 1 in a second position, in which the holder mates with one or more similarly shaped holders.

FIG. 2 is a side view of the beverage container holder 100 in a second position, in which the holder mates with one or more similarly shaped holders, such as holder the 200. As a group the plurality of holders 100, 200 occupy relatively less space in the second position than in the first position, and therefore the second position can be considered a storage or transportation position. So that the beverage container holder 100 can be placed in the second position, the holder 100 is configured to mate with other similarly shaped holders. For example, with reference to FIG. 1, the inner wall 105 has the taper 118 that continuously decreases from the top 112 to the bottom 114 of the cavity 108, and the outer wall 106 also has the taper 120 that continuously increases from the upper end 125 to the lower end 124. Although the beverage container holder 100 as shown is configured to mate with other similarly shaped holders, such a configuration is not required.

With reference back to FIG. 2, the beverage container holders 100, 200 can be moved from the first position to the second position. The supporting member 101 of the beverage container holder 100 is inserted into the supporting member 201 of the beverage container holder 200 such that stabilizing member 102 of the beverage container holder 100 slides along an outer side of the stabilizing member 202 of the beverage container holder 200 until the beverage container holder 100 comes to rest.

Figure 3:
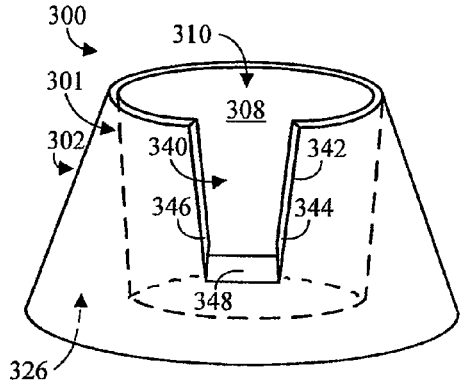
FIG. 3 is a side view of another embodiment of a beverage container holder.

FIG. 3 is a side view of another embodiment of a beverage container holder 300. The beverage container holder 300 is substantially the same as the beverage container holder 100, having the supporting member 301 and the stabilizing member 302. However, the beverage container holder 300 also includes a handle opening 340 that is configured to receive a handle of a beverage container. In such an embodiment, the supporting member 301 has a gap or space formed in a portion of the supporting member, and a similarly sized and shaped gap or space is formed in an adjacent portion of the stabilizing member 302. The gaps or spaces form the handle opening 340, which may be surrounded on a perimeter 342 by a connecting wall 344. The connecting wall 344 extends between the supporting member 301 and the stabilizing member 302, coupling the supporting and stabilizing members together. The connecting wall 344 also forms a boundary that separates the handle opening 340 from a void 326 on an interior of the beverage container holder 300 between the supporting member 301 and the stabilizing member 302. As shown, the connecting wall 344 is a series of panels including a two vertical panels 346 that extend from the opening 310 of the cavity 308 to a lower horizontal panel 348 that couples the two vertical panels together. In other embodiments, however, the handle opening 340 and the connecting wall 344 can have other configurations. For example, the handle opening 340 may be curved in which case the connecting wall 344 may be a single, curved panel.

In use, the beverage container holder 300 is placed on a surface. The handle of the beverage container is oriented in alignment with the handle opening 340, and the beverage container is lowered into the beverage container holder 300. The handle of the beverage container projects through the handle opening 340 to an exterior of the beverage container holder 300, such that the handle is accessible for raising and lowering the beverage container into and out of the holder. When the beverage container is inserted into the cavity 308, the beverage container holder 300 stabilizes the beverage container. When the beverage container is removed from the cavity 308, the beverage container holder 300 may mate with one or more other similarly shaped beverage container holders for compact transportation and storage. For example, the beverage container holder 300 may mate with another beverage container holder 300, or with the beverage container holder 100.

Providing the handle opening 340 may be desirable in cases in which the beverage container holder 300 is used with a handled beverage container. Without the handle opening 340, the handle must be accommodated within the beverage container holder, requiring a relatively wider cavity. A relatively wider cavity may inhibit the beverage container holder from adequately stabilizing the beverage container. For example, the supporting member may be inadequately spaced from the beverage container such that the beverage container moves with respect to the cavity, causing spills. Therefore, the handle opening 340 enables the supporting member to be in closer proximity to the beverage container than if the handle opening 340 was not provided, such that the beverage container is stabilized in the upright position. Note that in such embodiments, the beverage container holder 300 optionally can be used with a beverage container that either has or does not have a handle.

Like the beverage container 100, the beverage container 300 can have a variety of shapes and sizes, and can be formed from a variety of materials. For example, the cavity 308 may be sized and shaped for use with a coffee cup. Because handled beverage containers are often used to hold beverages that are warm, in at least some embodiments all or part of the beverage container 300 may be formed from an insulating material. For example, one or both of the supporting member 101 and the stabilizing member 102 may be an insulating material, and/or may have a double-wall construction. In some cases the void 326 between the walls may also be filled with an insulating material, in which case an end cap may be coupled to the lower end of the beverage container holder 300 to enclose the insulating material within the void 326.

Figure 4:
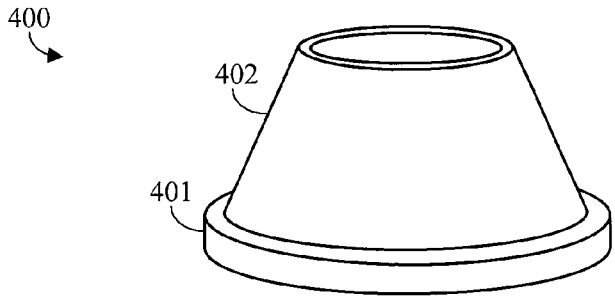
FIG. 4 is a side view of another embodiment of a beverage container holder.

FIG. 4 is a side view of another embodiment of a beverage container holder 400. The beverage container holder 400 includes a supporting member 401 and a stabilizing member 402. The supporting member 401 and the stabilizing member 402 are separate, matable pieces (shown in FIGS. 5-6) so that the beverage container holder 400 can be moved between a first or assembled position (shown in FIG. 4) and a second or unassembled (shown in FIG. 7). The first position is a functional position, and the second position is a storage and/or transportation position, as described in greater detail below.

Figure 5:
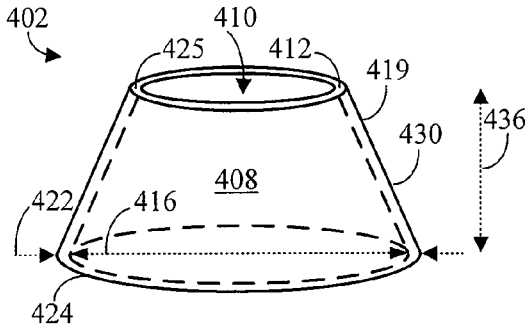
FIG. 5 is a side view of a stabilizing member of the beverage container holder shown in FIG. 4.

FIG. 5 is a side view of the stabilizing member 402 of the beverage container holder 400. The stabilizing member 402 forms a cavity 408 having an opening 410 into which a beverage container can be placed. Therefore, an inner dimension 416 of the stabilizing member 402 is at least the width of the beverage container with which the beverage container holder 400 is intended to be used. The stabilizing member 402 laterally supports the beverage container, such as by restricting the lateral movement of the beverage container. Therefore, at one or more points along a height 436 of the stabilizing member 402, the inner dimension 416 of the stabilizing member 402 is not substantially greater than the width of the beverage container. In embodiments in which the stabilizing member 402 is configured to mate with other similarly shaped stabilizing members, the stabilizing member 402 has a taper 419 such that the inner dimension 416 continuously increases from a minimum value at an upper end 425 to a maximum value at a lower end 424 of the stabilizing member 402. In such a case, the reduced inner dimension 416 of the stabilizing member 402 at the upper end 425 restricts the lateral movement of the beverage container. However, other configurations are possible. For example, the inner dimension 416 may be substantially uniform along the height 436 of the stabilizing member 402, such that lateral movement of the beverage container is restricted along the entire height.

The stabilizing member 402 is also configured to stabilize the beverage container holder 400 with respect to a surface on which it rests. Therefore, an outer dimension 422 of the stabilizing member 402 is not uniform along the height 436 of the stabilizing member 402. Instead, the outer dimension 422 at the lower end 424 of the stabilizing member 402 is greater than the outer dimension 422 at the upper end 425 of the stabilizing member. In some embodiments, the outer dimension 422 at the lower end 424 may be greater in more than one direction (x, y), the directions (x, y) defining a plane on which the beverage container holder 400 is configured to rest, such as the plane 199 described above with reference to FIG. 1. For example, in the illustrated embodiment the stabilizing member 402 has the taper 419 such that the outer dimension 422 continuously increases from a minimum value at the upper end 425 to a maximum value at the lower end 424. Therefore, in the illustrated embodiment, the outer dimension 422 at the lower end 424 is greater than the outer dimension 422 at the upper end 425 in every direction (x, y), although other configurations are possible similar to the embodiment of FIGS. 1-2.

In some embodiments, the stabilizing member 402 is a sleeve 430. For example, the sleeve 430 may be a frusto-conical sleeve, as shown. The inner dimension 416 is a minimum inner diameter of about 3.25 inches at the upper end 425 and is a maximum inner diameter of about 5.75 inches at the lower end 424. The outer dimension 422 is a minimum outer diameter of about 3.45 inches at the upper end 425 and is a maximum outer diameter of about 5.95 inches at the lower end 424. In other words, the stabilizing member 402 may have a thickness of about 0.1 inches along the height 436 of the stabilizing member 402, which is about 2 inches, and the taper 419 is substantially linear such that the inner dimension 416 and the outer dimension 422 uniformly increase along the height.

Figure 6:
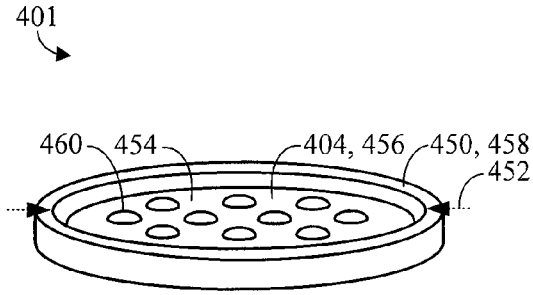
FIG. 6 is a side view of a supporting member of the beverage container holder shown in FIG. 4.

FIG. 6 is a side view of an exemplary supporting member 401 of the beverage container holder 400. The supporting member 401 is configured to substantially support the weight of the beverage container. The supporting member 401 includes a base 404 and a flange 450. The base 404 may be, for example, a plate or a coaster. The flange 450 is coupled to an upper side 454 of the base 404 and is shaped to mate with the lower end 424 of the stabilizing member 402. An inner dimension 452 of the flange 450 is substantially the same as but slightly greater than the outer dimension 422 of stabilizing member 402 at the lower end 424. Protrusions 460 are also included on the upper side 454 of the base 404, as further described below. As shown, the base 404 is a circular plate 456, and the flange 450 is a cylindrical ring 458 around a periphery of the base. The height of the flange 450 is about 0.25 inches, and the inner dimension 452 of the flange is substantially the same as but slightly greater than 5.95 inches.

Although the beverage container holder 400 is described above with reference to FIGS. 5-6 as being a certain shape and having certain dimensions, the holder may have other configurations. For example, the stabilizing member 402 need not be a frusto-conical sleeve 430, in which case the base 404 may not be the circular plate 456 and the flange 450 may not be the cylindrical ring 458. Regardless of the size or shape of the beverage container holder 400, however, the stabilizing member 402 has the opening 410 leading to the cavity 408, such that the beverage container can be inserted into the cavity, and the outer dimension 422 of the stabilizing member 402 is greater at the lower end 424 than at the upper end 425 of the stabilizing member.

In embodiments in which the beverage container holder 400 is designed to mate with other similarly shaped holders, the supporting member 401 is separate from the stabilizing member 402, and the stabilizing member has the taper 419 such that the inner dimension 416 and the outer dimension 422 of the stabilizing member 402 continuously increase from the upper end 425 to the lower end 424. As a result, the stabilizing member 402 is configured to mate with other stabilizing members 402, and the supporting member 401 is configured to be stacked on top of other supporting members. However, the stabilizing member 402 need not have the taper 419, or alternatively, the taper 419 need not be linear. Also, the stabilizing member 402 and the supporting member 401 need not be separate from each other, in which case the flange 450 can be omitted completely.

The supporting member 401 and the stabilizing member 402 can be formed from a variety of materials. For example, a non-conductive material can be used, such that the beverage container holder 400 does not tend to conduct heat toward or away from the beverage container, or an insulating material can be used such that the beverage container holder, for example, the stabilizing member 402, is configured to assist in maintaining the temperature of the beverage container. Alternatively, the stabilizing member 402 and, optionally the supporting member 401, can have a double wall construction having an inner hollow space between the walls to provide an insulating effect for the beverage container. In some embodiments, the beverage container holder 400 may be formed from more than one material, with different materials being used for different elements of the holder. For example, the flange 450 may be formed from a relatively flexible material such as rubber, so that the flange can give as the stabilizing member 402 is inserted into the supporting member 401 and can grip the stabilizing member 402 once it is in place. The base 404 may be formed from a relatively inflexible material such as plastic, enabling the base to properly support the stabilizing member 402 and any beverage container that is inserted into the cavity 408. In cases in which the flange 450 and the base 404 are formed from different materials, the two pieces may be coupled together in any known manner, such as with adhesive. The protrusions 460 may be integrally formed within the base 404, such as by molding the base, and therefore may be formed from the same material as the base. In other embodiments, the protrusions 460 are formed separate from the base 404 and are coupled to the base using, for example, an adhesive. In such cases the protrusions 460 can be formed from a different material than the base 404. For example, the protrusions 460 may be formed from a material having a relatively high coefficient of friction, such as rubber, such that the protrusions limit the movement of the beverage container within the beverage container holder 400 for added stability. In other embodiments not shown, a drainage hole may also be formed through the base 404, providing an avenue for condensation to escape.

Figure 7:
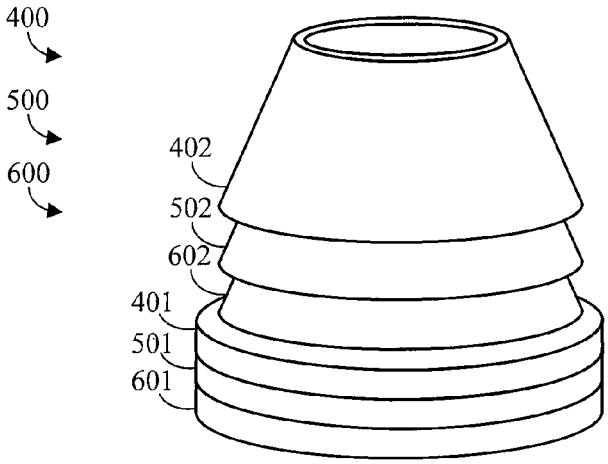
FIG. 7 is a side view of the beverage container holder shown in FIG. 4, illustrating the beverage container holder in a second position.

As shown in FIGS. 5-6, the supporting member 401 is separate from the stabilizing member 402, so that the beverage container holder 400 can be moved between the first position shown in FIG. 4 and the second position shown in FIG. 7. The first position may be a functional position, in which the supporting member 401 is configured to support the weight of the beverage container, the stabilizing member 402 is configured to stabilize the beverage container in the cavity 408, and the stabilizing member 402 is configured to stabilize the holder 400 with respect to the surface on which the holder rests. The first position may also be an assembled position, in which the parts of the beverage container holder 400 are assembled together, as shown in FIG. 4. To achieve this position, the stabilizing member 402 of FIG. 5 is inserted into the supporting member 401 of FIG. 6. The stabilizing member 402 is coupled to the upper side 454 of the base 404 extending away from the base, with the flange 450 holding the supporting member 401 in place, such as by friction or by a snap fitting. The protrusions 460 raise the beverage container off of the base 404, such that the beverage container does not contact condensation collected there. In embodiments not shown, the supporting member 401 and the stabilizing member 402 may not be movable between an assembled position and an unassembled position. In such embodiments, the beverage container holder 400 may be a single piece preformed into the first position shown in FIG. 4, with the flange 450 either present or omitted from the design.

FIG. 7 is a side view of the beverage container holder 400 in the second position. The second position may be an unassembled position, in which the beverage container holder 400 is not assembled. To change the beverage container holder 400 from the assembled position to the unassembled position, the supporting member 401 is separated from the stabilizing member 402. For example, the two pieces may be separated by pulling them apart. The stabilizing member 402 may then be stacked onto the stabilizing members 502, 602 of other similarly shaped beverage container holders 500, 600, and likewise the supporting member 401 may be stacked, or nested, onto the other supporting members 501, 601. The second position may also be a storage and/or transportation position, in which the beverage container holder 400 can be stored or transported. Such a position may be conducive to storage and/or transportation, because as a group the plurality of beverage container holders 400, 500, 600 occupy relatively less space in the storage position than in the functional position.

The operation of the beverage container holder 400 will now be described, with reference to FIGS. 4-7. The beverage container holder 400 may be stored and transported in the second position shown in FIG. 7. Once the beverage container holder 400 has been transported, the holder may be reconfigured from the second or unassembled position shown in FIG. 7 into the first or assembled position shown in FIG. 4. The stabilizing member 402 is inserted into the supporting member 401, for example, creating friction between the flange 450 and the stabilizing member 402 to hold the pieces together. The beverage container holder 400 is then placed on the surface so that the opening 410 into the cavity 408 is exposed and is substantially upright. A beverage container (not shown) that is inserted through the opening 410 into the cavity 408 is retained in a stable and upright position, less likely to tip over or be tipped over, without being exposed to debris on the surface.

To clearly illustrate the features of the beverage container holder, the holders 100, 300, and 400 are described separately above. However, a variety of embodiments having features combined from more that one of the beverage container holders 100, 300, and 400 are included within the scope of the present disclosure. For example, the beverage container holder 100 can be employed in combination with the supporting member 401 described with reference to the holder 400. In such an embodiment, the base 104 may be omitted from the supporting member 101. As another example, the stabilizing member 402 described with reference to the holder 400 can have a handle opening similar to the handle opening 340 described with reference to the holder 300, such that the holder 400 can be used with a handled beverage container. Additionally, the protrusions 460 described with reference to the supporting member 401 can also be included on the supporting member 101 of the holder 100, such that the holder 100 elevates the beverage container out of contact with condensation that may have collected in the cavity 108. These are mere examples of combinations that are included within the scope of the present disclosure.

While particular embodiments of a beverage container holder have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

At least the following is claimed:

1. A beverage container holder comprising:

a supporting member configured to laterally and axially support a beverage container in a generally upright position within the beverage container holder, the supporting member including an inner wall that forms a cavity having an opening so that a beverage container can be placed into the cavity through the opening, the inner wall being configured to restrict the beverage container within the cavity from moving laterally, a base coupled to the inner wall within the cavity, the base being configured to substantially support the weight of the beverage container within the cavity; and the inner wall having a taper such that an inner dimension of the cavity continuously decreases from a maximum value at a top to a minimum value at a bottom of the cavity; and a stabilizing member configured to stabilize the beverage container holder with respect to a surface on which the holder rests, the stabilizing member having an outer dimension that is greater at a lower end of the stabilizing member than at an upper end of the stabilizing member;

the upper end of the stabilizing member being coupled to the top of the supporting member, the stabilizing member stabilizing the cavity with respect to a surface on which the beverage container holder rests;

wherein the beverage container further comprises a handle opening formed through a side of the beverage container, such that when a handled beverage container is inserted into the cavity of the beverage container holder, a handle of the beverage container projects through the handle opening to an exterior of the beverage container holder, the handle opening formed generally vertically through both the supporting member and the stabilizing member, the handle opening beginning in a generally vertical direction at the top of the supporting member, and including opposed handle opening sides, each handle opening side connecting the supporting member to the stabilizing member, the opposed handle opening sides converging towards each other along the handle opening from the top of the handle opening at the top of the supporting member towards the bottom of the handle opening such that the distance between the opposed handle opening sides is greater at the top of the handle opening than at the bottom of the handle opening; and wherein a void is formed between the supporting member and the stabilizing member, such that the beverage container holder can be stacked on another similarly shaped beverage container holder by inserting the base of the beverage container holder into the cavity of the other beverage container holder and advancing the supporting member of the beverage container holder into the cavity of the other beverage container holder, causing the handle opening of the beverage container to nest within the handle opening of the other beverage container holder.

2. The beverage container holder of claim 1, wherein a height of the cavity is less than a height of the beverage container stabilizing member, such that the base of the beverage container supporting member is suspended above the surface on which the beverage container holder rests.

3. The beverage container holder of claim of claim 1, wherein the supporting member is an inwardly tapered cylindrical sleeve, and the stabilizing member is an outwardly tapered cylindrical sleeve, and the base is a circular plate.

4. The beverage container holder of claim 1, wherein the stabilizing member is coupled to the supporting member at the opening into the cavity, and the base is coupled to the supporting member at a bottom of the cavity.

5. The beverage container holder of claim 1, wherein the supporting member has protrusions configured to elevate the beverage container off of the base of the supporting member such that the beverage container does not contact condensation accumulated within the supporting member.

6. The beverage container holder of claim 1, wherein the supporting member is inwardly tapered and the stabilizing member is outwardly tapered, such that the beverage container holder is configured to be stacked onto other similarly shaped holders, the holders as a group occupy relatively less space than the holders individually.

7. The beverage container holder of claim 1, wherein the outer dimension of the stabilizing member is greater at the lower end than at the upper end in at least two directions with respect to a plane on which the beverage container holder is configured to rest.

8. The beverage container holder of claim 1:

the supporting member configured to support the weight of a beverage container; and the stabilizing member configured to restrict the lateral movement of the beverage container at one or more points along a height of the stabilizing member, and configured to stabilize the beverage container holder with respect to a surface on which the holder rests, the stabilizing member having an outer dimension that is greater at a lower end of the stabilizing member than at an upper end of the stabilizing member.

* * * * *